US005104563A

United States Patent [19]

Anchor et al.

[11] Patent Number: 5,104,563

[45] Date of Patent: Apr. 14, 1992

[54] LOW MOLECULAR WEIGHT POLYPROPYLENE SURFACTANTS WHICH INTERACT WITH ANIONIC AND NONIONIC SURFACTANTS

[76] Inventors: Michael J. Anchor, 14056 Riverside Dr., Livonia, Mich. 48154; Robert R. Roelofs, 2099 McLane, Lincoln Park, Mich. 48146

[21] Appl. No.: 725,390

[22] Filed: Jun. 27, 1991

Related U.S. Application Data

[63] Continuation of Ser. No. 478,901, Feb. 12, 1990, abandoned, which is a continuation-in-part of Ser. No. 287,125, Dec. 30, 1988, abandoned.

[51] Int. Cl.[5] ..... C11D 7/08; C11D 7/32; C11D 1/12; C23G 1/02

[52] U.S. Cl. ..... 252/142; 252/173; 252/174.22; 252/548; 252/551; 252/DIG. 1; 252/DIG. 14; 134/41

[58] Field of Search ..... 252/142, 173, 174.22, 252/548, 551, DIG. 1, DIG. 14; 134/41

[56] References Cited

U.S. PATENT DOCUMENTS

| | | | |
|---|---|---|---|
| 3,034,989 | 5/1962 | Michaels | 252/135 |
| 4,235,734 | 11/1980 | Scherubel | 252/142 |
| 4,410,447 | 10/1983 | Decker et al. | 252/351 |
| 4,624,803 | 1/1986 | Balzer et al. | 252/527 |

*Primary Examiner*—A. Lionel Clingman
*Assistant Examiner*—William S. Parks

[57] ABSTRACT

A surfactant blend solution which maintains its homogeneity up to the boiling point of the solution, comprising:

(a) a surfactant;

(b) a low molecular weight polypropylene glycol; and (c) the balance an aqueous medium comprising about 5 to 20 use percent mineral acid, whereby the ratio of (a) to (b) is from about 1:10 to 10:1, said surfactant blend solution useful in metal finishing, electroplating, electrolytic metal deposition, acidic cleaning, spray applications, and rinse aids for automatic dishwashing applications.

12 Claims, No Drawings

LOW MOLECULAR WEIGHT POLYPROPYLENE SURFACTANTS WHICH INTERACT WITH ANIONIC AND NONIONIC SURFACTANTS

This is a continuation of copending application Ser. No. 478,901, filed on Feb. 12, 1990.

This application is a continuation in part of our earlier co-pending application, Ser. No. 287,125, filed Dec. 20, 1988, now abandoned.

BACKGROUND OF THE INVENTION 1. Field of the Invention

The present invention relates to a mixture of surfactants which may be anionic or nonionic and a low molecular weight polypropylene glycol which, when placed in an acidic solution, give a homogeneous solution which, maintains its homogeneity over a wide range of temperature. Another advantage which has been discovered is that in the case of nonionic surfactants, low foam characteristics are observed. The present invention further relates to surface active agents for use in high operating temperatures and high agitation applications. The present invention further relates to the use of such surfactant blends in metal finishing, electroplating, electrolytic metal deposition, acidic cleaning, especially spray applications and rinse aids for automatic dish cleaning compositions.

The present invention further relates to the incorporation of such surfactant blends for use in any application wherein it is desired to have high cloud point and to maintain low foaming.

2. Description of the Related Art

Feighner, U.S. Pat. No. 3,539,518, discloses a low foam nonionic surfactant composition which consists of lower $C_1$–$C_8$ straight chain acyl group capped alcohol ethoxylates. The Patent, at column 3, is addressed to the fact that higher cloud points are indicative of greater water solubility and are desirable in certain applications. Although Feighner et al disclose high cloud point surfactants of a general formula which could be derived through reactions from surfactants of the present invention, Feighner et al are not concerned with the same family of nonionic surfactants as the present invention. Further, Feighner et al do not disclose the use of these surfactants with a low weight polypropylene glycol as a surfactant blend and in acidic medium.

Decker et al, U.S. Pat. No. 4,410,447 disclose a liquid low foaming nonionic surfactant which has good wetting characteristics and good scouring and detergency properties. The surfactant comprises a block-random structure represented by the formula:

$$R—O—A_x—B—H$$

wherein R is a primary alkyl group having from 7–11 carbon atoms, A is oxypropylene, x is an integer from 2–15 with the proviso that the sum of the number of carbon atoms in the alkyl group and x is from 12 to about 22, B is a random mixture of oxyethylene oxypropylene groups with molar ratio of oxyethylene to oxypropylene in the mixture being such that the total ratio of oxyethylene to oxypropylene in A and B is from 0.2:1 to 1.5:2 while the molar ratio of oxyethylene to oxypropylene in the random mixture is 1:1 and preferably from 2:1 to 5:1. The R—O is defined as the residue of the alcohol employed in the condensation reaction with hydrogen. The surfactants disclosed in Decker et al have a cloud point ranging from 20° to 60° C. There is no showing in Decker et al of the high cloud points of the present invention nor of the use of nonionic surfactants with a low weight polypropylene glycol in an acidic medium to render surfactant blends which have low foaming characteristics and high cloud points and are useful in the applications as previously noted herein.

Fong et al, U.S. Pat. No. 4,592,809 disclose nonionic surfactants prepared by the reaction of ethoxylated bis-phenols and sulfating agents. These surfactants are useful in metal electroplating baths and processes to increase the useful operating temperature limits of the bath in comparison to those using other surfactants. A high cloud point is desired in the medium and it is necessary that this surfactant be capable of serving its intended purpose and not otherwise affecting the bath plating or deposition characteristics of the electroplating bath. Fong e al differ from the present invention because Fong et al achieve these characteristics by use of a sulfating agent, whereas the present invention achieves this result using polypropylene glycol.

Boehmer, U.S. Pat. No. 3,890,238 discloses liquid polyoxyalkylene polymers which demonstrate an increased cloud point which may be raised by the addition to the solution of an alkali metal salt of an organic thiol acid having at least one —SH group. The present invention is not concerned with the addition of alkali metal salts of organic thiol acids having at least one —SH group to raise the cloud point. Rather, the present invention is directed to the use of certain nonionic surfactants and anionic surfactants with a low weight polypropylene glycol in an acidic medium to produce a low foam, high cloud point surfactant blend.

None of the art, insofar as is known, discloses an aqueous mixture of a nonionic surfactant or an anionic surfactant with a low molecular polypropylene glycol in an acidic medium.

The block copolymers useful in the present invention may be a polyoxyethylene/polyoxypropylene type surfactant or, may be of the polyoxypropylene/polyoxyethylene nonionic surfactants. What is also unexpected in the present invention, is that certain anionic surfactants may be used in an acidic medium together with a low molecular weight polypropylene glycol to produce a high cloud point surfactant blend. It was previously known in the art that an anionic surfactant in an acidic medium would oil out of solution.

It has been discovered that certain anionic surfactants which contain at least some ethylene glycol hydrophilicity, when blended with a low molecular weight polypropylene glycol, produce a clear surfactant blend in acidic medium which has a very high cloud point. These anionic surfactants have the general formula:

$$R—O(C_2H_4O)_n—SO_3X$$

wherein R is a hydrocarbon chain, an aromatic ring, a combination of a hydrocarbon chain and an aromatic ring, and mixtures thereof, containing 7 to 15 carbon atoms, and n is a number from 2 to 14, and X is a hydrogen atom or alkali metal such as sodium or potassium.

SUMMARY OF THE INVENTION

The present invention is a mixture of nonionic surfactants or certain anionic surfactants with a low molecular weight polypropylene glycol in an acidic solution. It has been surprisingly found that when such surfactants are mixed with low molecular weight polypropylene glycol in an acidic solution, a low foaming, high cloud point surfactant blend is the result with respect to the nonionic surfactant and a high cloud point with respect to the anionic surfactants. The applications for their invention include metal finishing, electroplating, electrolytic metal deposition, acidic cleaning, spray cleaning applications and rinse aids for automatic dishwashing applications.

The surfactant blend is present in an amount of from about 1 to 10 percent by weight of the composition. The blend is comprised of from about 1:10 to 10:1 surfactant to polypropylene glycol, and preferably a 1:1 ratio of surfactant to polypropylene glycol. The blend is placed in a 5 to 30 percent acidic solution where 5 to 20 percent is the use concentration. It is surprising that an anionic surfactant in an acidic medium would form a high cloud point surfactant blend. Accordingly, it is an object of the present invention to form low foaming, high cloud point nonionic surfactant blends, and high cloud point anionic surfactant blends which are useful in a wide range of applications. Other objects and purposes of the invention will become evident upon a reading of the specification and appended claims.

DETAILED DESCRIPTION OF THE PREFERRED EMBODIMENT

The present invention is a mixture of nonionic surfactants which may be either polyoxyethylene/polyoxypropylene polyols or polyoxypropylene/polyoxyethylene polyols with a low molecular weight polypropylene glycol in an acidic medium to give a solution which has low foaming characteristics and virtually no cloud point.

It has been discovered that certain anionic surfactants which contain at least some hydrocarbon hydrotrope, when blended with a low molecular weight polypropylene glycol, produce a clear surfactant blend in acidic medium which has a very high cloud point. These anionic surfactants have the general formula:

$$R—O(C_2H_4O)_n—SO_3X$$

wherein R is a hydrocarbon chain, an aromatic ring, a combination of a hydrocarbon chain and an aromatic ring, and mixtures thereof, containing 7 to 15 carbon atoms, and n is a number from 2 to 14, and X is a hydrogen atom or an alkali metal such as sodium or potassium. It had previously been thought that anionic surfactants cannot be used in acidic medium because they would oil out of solution. It has now been found that by incorporation of the anionic surfactant with a low molecular weight polypropylene glycol, it is possible to produce in an acidic medium, a stable high cloud point surfactant blend using an anionic surfactant.

The present invention more specifically entails the use of a surfactant blend which is comprised of a mixture of surfactant and a low molecular weight polypropylene glycol in a ratio of 1:10 to 10:1 surfactant to polypropylene glycol, and preferably a 1:1 ratio of surfactant to polypropylene glycol. The blend is used in a 5 to 20 percent acidic solution, where 5 to 20 percent is the use concentration. When subjected to tests to measure the cloud point, a high cloud point was observed which approached the boiling point of the solution. Similarly, at least the nonionic surfactant blend possessed low foam characteristics and a high cloud point over a wide range of operating temperatures.

Suitable nonionic surfactants may be polyoxyalkylene polyethers terminated with oxyethylene groups. Generally, the terminal atom on the chains of such compounds is a hydrogen atom which is preceded by the polyoxyethylene group. However, for simplicity's sake, and as generally used in the art, the expression "terminated with the oxyethylene group," as used throughout the instant specification and claims, includes compounds having terminal hydrogen atoms.

A preferred type of oxyethylene group terminated polyoxyalkylene polyethers is a cogeneric mixture of conjugated polyoxyalkylene compounds containing in their structure, oxyethylene groups, oxypropylene groups and the residue of an active hydrogen containing compound. The term "cogeneric mixture" used herein is a term that has been coined to designate a series of closely related homologues that are obtained by condensing a plurality of alkylene oxide units with a reactive hydrogen compound. This expression is well known to those skilled in the art as can be seen from U.S. Pat. Nos. 2,677,700; 2,674,619; and 2,979,528.

The active hydrogen containing compound also referred to herein as an initiator has about 1 to 30 carbon atoms, preferably about 1 to 14 carbon atoms, and at least 1, preferably about 1 to 8, active hydrogen atoms. Typical initiators useful in the present invention include monofunctional or polyfunctional alcohols such as methanol, ethanol or higher branched or unbranched monofunctional alcohols, hexyl alcohol, octyl alcohol, decyl alcohol, stearyl alcohol, and mixtures thereof, phenol, alkyl phenols and dialkyl phenols, difunctional alcohols such as ethylene glycol, propylene glycol, butylene glycol, ethylenediamine, triethylenediamine, hexamethylenediamine, trimethylol propane, pentaerythritol, sucrose and erythritol, $C_1$–$C_{30}$ mono- or polyalkyl phenols, polyhydroxy alkylated phenols, hydrogenated (polyphenol) alkanes, polyphenols where the aromatic rings are fused or bridged by alkyl groups or are linked directly but not fused, such as diphenols, oxy alkylated alkyl amines, aniline or other aromatic amines or polyamines, fatty acids, fatty amides, oxyalkylated fatty acids, oxyalkylated fatty amides and mixtures thereof.

Broadly defined, the initiator may be a 1,2- or 1,X-difunctional alcohol where X is an integer not exceeding the number of carbon atoms in the alcohol, monoalkyl ethers of the above-mentioned glycols, or other higher functional alcohols.

Other typical initiators may include amines, amides, mercaptans and carboxylic acids. Indeed, other surfactants may be useful as starting materials for the instant invention. These include oxyalkylated amines, oxyalkylated fatty acids and oxyalkylated fatty amides.

These initiator compounds may be heteric or block, as long as they are terminated with oxyethylene groups and are characterized in that the oxyalkylene groups are attached to the initiator compound at the site of the reactive hydrogen atoms.

In another embodiment of this invention, the oxyalkylene compounds are those of the type disclosed in U.S. Pat. No. 2,674,619 prepared by first oxypropylating an initiator and subsequently oxyethylating the resulting compound as more completely described in the above-mentioned patent, incorporated herein by reference. In such compounds, the polyoxypropylene groups are attached to the initiator nucleus at the site of the reactive hydrogen atoms, thereby constituting a polyoxypropylene polymer. The oxyethylene chains are attached to the polyoxypropylene polymer in oxyethylene chains. The oxypropylene chains optionally, but advantageously, contain small amounts of ethylene oxide and the oxyethylene chains optionally but advantageously contain small amounts of other alkylene oxides such as propylene oxide and/or butylene oxide. Such compounds are believed to correspond to the formula:

$$Y[(C_3H_6O)_n(C_2H_4O)_mH)]_x \quad \text{I}$$

Wherein Y is the residue of an organic compound having from about 1 to 30, preferably about 1 to 14 carbon atoms and containing x reactive hydrogen atoms in which x has a value of at least 1, preferably about 1 to 8, n has a value such that the molecular weight of the polyoxypropylene hydrophobic base is about 300 to 23,750 and m has a value such that the oxyethylene content of the molecule is from about 10 to 90, preferably 10 to 50 weight percent of the molecule.

It is further noted that when the molecular weight is stated in this specification or in the claims, unless otherwise noted, there is meant the average theoretical molecular weight which equals the total of the grams of the alkylene oxide employed per mole of reactive hydrogen compound. It is well recognized in the field of alkylene oxide chemistry that the polyoxyalkylene compositions one obtains by condensing an alkylene oxide with a reactive hydrogen compound are actually polymeric mixtures of compounds rather than a single molecular compound. The mixture contains closely related homologues wherein the statistical average number of oxyalkylene groups equals the number of moles of the alkylene oxide employed and the individual members in the mixtures contain varying numbers of oxyalkylene groups. Accordingly, as already noted, the oxypropylene chains optionally but advantageously may contain small amounts of ethylene oxide and the oxyethylene chains optionally but advantageously contain small amounts of alkylene oxides such as propylene oxide and butylene oxide. Thus, the compositions of this invention are mixtures of compounds which are defined by molecular weight of the polyoxypropylene chains and weight percent of oxyethylene groups.

Preferred compounds of the Formula I are those where Y is a residue of propylene glycol, or propylene glycol mono methylether whereby the formula then becomes $$CH_3—O(C_3H_6O)_n—(C_2H_4O)_mH \quad \text{II}$$

or $$HO(C_2H_4O)_m(C_3H_6O)_n(C_2H_4O)_mH \quad \text{IIa}$$

wherein n has a value such that the molecular weight and the polyoxypropylene hydrophobic base is about 300 to 23,750, preferably 450 to 17,500, m has a value such that the oxyethylene content of the molecule is from about 10 to 90, preferably 10 to 50 weight percent of the molecule.

Nitrogen-containing polyoxyalkylene compositions are included in the present invention which are similar to those described in U.S. Pat. No. 2,979,528. These compounds are prepared in much the same manner as those disclosed in accordance with the procedure disclosed in U.S. Pat. No. 2,679,619. However, instead of propylene glycol or propylene glycol monomethyl ether as an initiator, a reactive hydrogen compound containing nitrogen is utilized. Initiators for these compounds include ammonia, primary amines, alkylene polyamines, alkanol amine and heterocyclic nitrogen compounds. Aliphatic primary diamines, having not over 8 carbon atoms are the preferred nitrogen-containing reactive hydrogen compounds and include ethylenediamine, diethylene triamine, triethylene tetraamine, tetraethylene pentaamine, hexamethylene diamine, phenylene diamine and the like.

Useful nitrogen-containing nonionic surfactants are mixtures of cogeneric polyoxypropylene/polyoxyethylene compounds based on a nitrogen-containing reactive hydrogen compound wherein chains of oxypropylene groups having a defined molecular weight are attached to the nucleus of the reactive hydrogen compound at the sites of the hydrogen atoms and wherein the chains of oxyethylene groups are attached to opposite ends of the oxypropylene chains. The compositions are prepared by condensing propylene oxide with a nitrogen-containing reactive hydrogen compound, preferably ethylenediamine and subsequently condensing ethylene oxide with the propylene oxide-reactive hydrogen compound. The collective molecular weight of the oxypropylene chains attached to the nitrogen-containing reactive hydrogen compound must be at least about 300 and can range up to about 23,750 or higher. Where ethylenediamine is the reactive hydrogen compound, these compounds are believed to have the following formula:

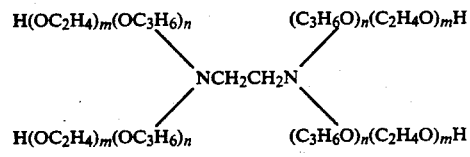

III wherein n has a value such that the overall molecular weight of the polyoxypropylene hydrophobic base is about 300 to 23,750, preferably about 450 to 17,500, and m has a value such that the polyoxyethylene hydrophilic base is from about to 90, preferably about 10 to 50 weight percent of the molecule.

Other preferred polyether surfactants are those wherein Y in Formula I above is methanol.

The preferred nonionic surfactants are conventional oxypropylene group terminated polyoxyalkylene polyols. More specifically, polymers prepared by reacting all the hydroxyl groups of the oxyethylene group terminated polyols with propylene oxide. For example, the polyols to be capped with the oxypropylene groups are similar to those described above, but having oxypropylene terminal groups such as those disclosed, including preparation thereof, in U.S. Pat. No. 3,036,118; which is oxypropylene group terminated.

Such polyoxyalkylene polyols capped with oxypropylene groups are believed to have the following generalized formula:

$$Y[(A)_m(C_3H_6O)_nH]_x \quad \text{IV}$$

wherein A is an oxyalkylene hydrophilic group selected from oxyethylene, which may contain small amounts of oxypropylene, oxybutylene, oxytetramethylene, as a heteric block thereof; m and n are whole numbers selected to give an overall molecular weight of the product of about 500 to 5,000; Y is as set forth above and n represents a value whereby the total number of oxypropylene groups in the compound is about 5 to 410.

In a preferred embodiment, x is 1 to 8, A comprises oxyethylene groups centrally located in the molecule with oxypropylene groups attached at each end thereof. In another embodiment, A is a heteric mixture of oxypropylene or oxybutylene groups with the oxyethylene groups. The preferred compounds prior to capping with oxypropylene generally have the formula:

$$Y[(C_2H_4O)_m(C_3H_6O)_nH]_x \qquad V$$

wherein Y is the residue of an organic compound having about 1 to 30 carbon atoms preferably 1 to 14 carbon atoms; x is the number of reactive hydrogen atoms and is from about 1 to 8; n has a value such that the molecular weight of all the polyoxypropylene in the conventional surfactant is from about 300 to 23,750 and m has a value such that the oxyethylene content of the molecule is from about 10 to 90, preferably 10 to 50 weight percent of the molecule. A preferred compound of this type prior to capping with oxypropylene is one wherein Y is ethylene glycol or propylene glycol whereby the formula is:

$$HO[(C_2H_4O)_n(C_3H_6O)_m]\,H \qquad VI$$

wherein m has the value set forth above for Formula V and n has a value such that the total molecular weight of the polyoxypropylene hydrophobic base is from about 300 to 23,750. These compounds are more particularly described in U.S. Pat. No. 3,036,118 incorporated herein by reference. In the products which are of the type more particularly described in U.S. Pat. No. 2,979,528, except that the propylene oxide and ethylene oxide groups are in reverse order, Y can also represent the reactive hydrogen compounds containing nitrogen and having up to about 6, inclusive carbon atoms. A preferred compound of this type is one where Y is ethylenediamine and the formula is:

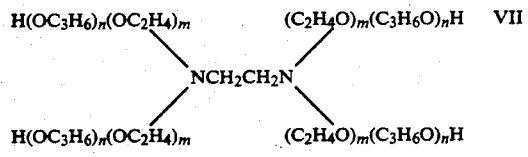

VII wherein n has a value such that the molecular weight of all the polyoxypropylene hydrophobic groups is about 300 to 23,750 and m has a value such that the oxyethylene content of the molecule is from about 10 to 90, preferably 10 to 50 weight percent of the molecule. Heteric structure are also included and the formula is modified according as is well known to one skilled in the art.

In another embodiment, Y in Formulas IV and V is trimethylolpropane. The polyols of Formulas V, VI, and VII are then capped with oxypropylene groups by methods well known to those skilled in the art whereby the total number of oxypropylene groups in the compound is from about 5 to 410.

It has been discovered that certain anionic surfactants which contain at least some ethylene glycol hydrophilicity, when blended with a low molecular weight polypropylene glycol, produce a clear surfactant blend in acidic medicine which has a very high cloud point. These anionic surfactants have the general formula:

$$R{-}O(C_2H_4O)_n{-}SO_3X$$

wherein R is a hydrocarbon chain, an aromatic ring, a combination of a hydrocarbon chain and an aromatic ring, and mixtures thereof, containing 7 to 15 carbon atoms, and n is a number from 2 to 14, and X is a hydrogen atom or an alkali metal such as sodium or potassium.

The polypropylene glycol useful in forming the surfactant blends of the present invention is preferably a low molecular weight polypropylene glycol having molecular weight of around 76 to 900 and preferably about 450. When used in conjunction with the preferred surfactants, the polypropylene glycol and surfactant become soluble in an acidic medium and produce a surfactant blend which, in the case of a nonionic surfactant, is low foaming and has virtually no cloud point, and in the case of an anionic surfactant, has an extremely higher cloud point.

The surfactant blend is comprised of a mixture of surfactant and a low molecular weight polypropylene glycol in a ratio of 1:10 to 10:1 surfactant to polypropylene glycol, and preferably in a 1:1 ratio of surfactant to polypropylene glycol. The blend is used in a 5 to 20 percent mineral acid medium, where 5 to 20 percent is the use concentration. The surfactant blend exhibits high cloud point and, in the case of nonionic surfactants, is low foaming as well.

As previously stated, applications for the present invention include metal finishing, electroplating, electrolytic metal deposition, especially spray applications, as well as acidic cleaning and rinse aids for automatic dishwashing applications.

The following examples are intended to illustrate various aspects of the invention. Those skilled in the art understand that they are not to be construed as limiting the scope and spirit of the invention.

KEY TO THE EXAMPLES

Surfactant No. 1 is a polyoxyethylene/polyoxypropylene block copolymer having a weight percent polyoxyethylene content of 40 and an average molecular weight of about 2200.

Surfactant No. 2 is a polyoxyethylene/polyoxypropylene heteric $C_{10}$–$C_{12}$ alcohol having an average molecular weight of about 820.

Surfactant No. 3 is an anionic surfactant of the formula:

$$R{-}O(C_2H_4O)_nSO_3X$$

wherein R is a hydrocarbon chain, an aromatic ring, a combination of a hydrocarbon chain and an aromatic ring, and mixtures thereof, containing 7 to 15 carbon atoms, and n is a number from 2–14, and X is a hydrogen atom or an alkali metal such as potassium or sodium.

PPG is polypropylene glycol having an average molecular weight of about 430.

EXAMPLE 1

TABLE 1

Low Foaming, High Cloud Point Surfactant Blends*

| Product | Cloud Point °C. | Surface Tension Dynes/cm | Ross Miles i | 30 | 60 | 90 | 120 |
|---|---|---|---|---|---|---|---|
| 2% of Surfactant No. 1 + 2% PPG in 15% | >100 | 37.5 | 10 | (no foam at 15 sec.) | | | |

TABLE 1-continued

Low Foaming, High Cloud Point Surfactant Blends*

| Product | Cloud Point °C. | Surface Tension Dynes/cm | Ross Miles i | 30 | 60 | 90 | 120 |
|---|---|---|---|---|---|---|---|
| HCL 2% of Surfactant No. 1 + 2% PPG aqueous | 65 | 39.2 | 50 | 30 | 20 | — | 15 |
| 2% of Surfactant No. 1 + PPG PH 10 | 63 | 40.0 | 38 | 22 | 18 | — | 15 |
| 2% of Surfactant No. 1 in 15% HCL | >100 | 45.9 | 30 | 10 | 0 | — | — |
| 2% of Surfactant No. 1 aqueous | 67 | 40.8 | 33 | 23 | 18 | — | 13 |
| 2% of Surfactant No. 1 pH 10 | 68 | 41.0 | 40 | 35 | 30 | — | 20 |
| 2% of Surfactant No. 2 + 2% PPG in 15% HCL | >100 | 37.1 | 158 | 130 | 25 | — | 0 |
| 2% of Surfactant No. 2 + 2% PPG aqueous | 73 | 35.5 | 175 | 158 | 138 | — | 20 |
| 2% of Surfactant No. 2 15% HCL | >100 | 37.9 | 170 | 135 | 120 | 75 | 20 |
| 15% HCL/ 2% of Surfactant No. 3 | Oiled | | Oiled, added PPG to clear | | | | |

*Foam Measurement - Ross Miles - 50° C. the height measured in mm at the initial time and at 30, 60, 90 and 120 seconds.

EXAMPLE 2

| Acid TYPE/ WT % | Surfactant 2% Surfactant No 2 2% PPG | C.P. (1) | FOAM HEIGHT (2) i | 30s | 60s | 90s |
|---|---|---|---|---|---|---|
| NONE | — | 73 | 185 | 170 | 135 | 20 |
| HCl/15% | — | >100 | 137 | 28 | 0 | 0 |
| $H_3PO_4$/15% | — | 81 | 160 | 120 | 25 | 5 |
| $H_2SO_4$/15% | — | 83 | 180 | 140 | 40 | 10 |

(1) Cloud Point in °C. = C.P.
(2) ROSS MILES
i = initial
s = seconds

When the tables are reviewed, it is obvious that blends of either surfactant 1 and 2 with polypropylene glycol in a mineral acid medium resulted in much elevated cloud points with excellent low foaming characteristics as measured by the Ross Miles test. Similarly, it can be seen that upon the addition of polypropylene glycol, surfactant No. 3 "cleared" rather than having the surfactant oiled out of solution. This surfactant blend exhibited a high cloud point.

The embodiments of the invention in which an exclusive privilege or property is claimed are defined as follows:

1. A low foam surfactant blend solution, comprising:

(a) a nonionic surfactant which is selected from the group of compounds consisting of $$Y[(C_3H_6O)_n(C_2H_4O)_mH]_x \quad \text{I}$$

$$Y[(C_2H_4O)_m(C_3H_6O)_nH]_x \quad \text{II}$$

wherein Y is the residue of an organic compound having from 1 to 30 carbon atoms and x reactive hydrogen atoms in which x has a value of at least 1, n has a value such that the molecular weight of the polyoxypropylene base is from about 300 to 23,750, and m has a value such that the oxyethylene content of the molecule is from about 10 to 90 weight percent of the molecule;

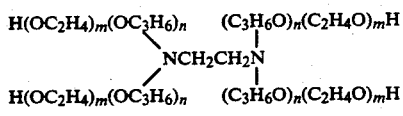

III

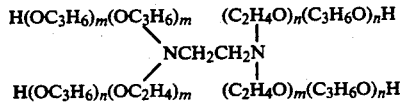

IV wherein n has a value such that the molecular weight of all the polyoxypropylene hydrophobic groups is about 300 to 23,750 and m has a value such that the oxyethylene content of the molecule is from about 10 to 90 weight percent of the molecule; and mixtures of I, II, II and IV;

(b) a low molecular weight polypropylene glycol having an average molecular weight of from about 76 to 900; and (c) the balance being an aqueous medium comprising about 5 to 20 use percent mineral acid, whereby the ratio of (a) to (b) is from about 1:10 to 10:1, said surfactant blend solution having a cloud point of equal to or greater than 63 degrees C. and being useful in metal finishing, electroplating, applications, and rinse aids for automatic dishwashing applications, said surfactant blend solution exhibiting no foam at 90 seconds when measured using the Ross-Miles method.

2. The surfactant blend of claim 1 wherein the ratio of (a) to (b) is about 1:1.

3. The surfactant blend of claim 1, wherein the polypropylene glycol has an average molecular weight of about 450.

4. The surfactant blend of claim 1, wherein said blend has a cloud point of greater than about 80° C.

5. The surfactant blend of claim 1, wherein said surfactant is a polyoxyethylene/polyoxypropylene block copolymer having a weight percent polyoxyethylene content of 40 and an average molecular weight of about 2200.

6. The surfactant blend of claim 1, wherein said surfactant is a polyoxyethylene/polyoxypropylene heteric $C_{10}$–$C_{12}$ alcohol having an average molecular weight of about 820.

7. The surfactant blend of claim 5, wherein said blend has a cloud point of greater than about 80° C.

8. The surfactant blend of claim 6, wherein said blend has a cloud point of greater than about 80° C.

9. The surfactant blend solution which is clear and cloud-free, comprising:

(a) an anionic surfactant which is selected from the group of compounds consisting of $$R—O(C_2H_4O)_4—SO_3X$$

wherein R is a $C_{7-15}$ hydrocarbon chain, an aromatic ring, and mixtures thereof, and n is a number from 2 to 14, and X is a hydrogen atom or sodium or potassium, (b) a low molecular weight polypropylene glycol having an average molecular weight of from about 76 to 900;

(c) the balance being an aqueous medium comprising about 5 to 20 use percent mineral acid, whereby the ratio of (a) to (b) is from about 1:10 to 10:1, said surfactant blend solution being useful in metal finishing, electroplating, electrolytic metal deposition, acidic cleaning, spray applications, and rinse aids for automatic dishwashing applications.

10. The surfactant blend of claim 5, wherein said surfactant blend has a cloud point of greater than 100.

11. The surfactant blend of claim 10, wherein said surfactant blend exhibits no foam at 15 seconds when measured using the Ross-Miles method.

12. The surfactant blend of claim 6, wherein said surfactant blend has a cloud point of greater than 100.

* * * * *